US005959424A

United States Patent [19]

Elkmann et al.

[11] Patent Number: 5,959,424

[45] Date of Patent: Sep. 28, 1999

[54] DRIVE DEVICE FOR MOVING A ROBOT OR VEHICLE ON FLAT, INCLINED OR CURVED SURFACES, PARTICULARLY OF A GLASS CONSTRUCTION AND ROBOT WITH DRIVE DEVICE

[75] Inventors: Norbert Elkmann, Magdeburg; Ulrich Schmucker, Irxleben; Holger Scharfe, Magdeburg; Christian Schoop, Magdeburg; Ingo Kubbe, Magdeburg, all of Germany

[73] Assignee: Fraunhofer-Gesellschaft Zur Foerderung Der Angewandten Forschung E.V., Munich, Germany

[21] Appl. No.: 09/058,637

[22] Filed: Apr. 10, 1998

[30] Foreign Application Priority Data

Apr. 11, 1997 [DE] Germany ..... 197 16 740
Apr. 11, 1997 [DE] Germany ..... 197 16 741

[51] Int. Cl.[6] ..... A47L 1/02

[52] U.S. Cl. ..... 318/568.12; 15/49.1; 901/1

[58] Field of Search ..... 318/568.11, 568.12; 15/49.1, 50.1, 50.2, 50.3; 901/1

[56] References Cited

U.S. PATENT DOCUMENTS 3,641,607 2/1972 Lemelson ..... 15/4
5,263,223 11/1993 Fiegel et al. ..... 15/321
5,465,446 11/1995 Chang ..... 15/50.3
5,715,557 2/1998 Hsu ..... 15/50.3

FOREIGN PATENT DOCUMENTS 0 271 454 6/1988 European Pat. Off. .
0 505 956 9/1992 European Pat. Off. .
27 37 619 3/1979 Germany .
08256963 10/1996 Japan .

*Primary Examiner*—Bentsu Ro
*Attorney, Agent, or Firm*—Marshall & Melhorn

[57] ABSTRACT

Proposed is a device for moving a robot or vehicle on surfaces, particularly of a glass construction, which has a support frame provided with wheels, which forms a component part of the robot or vehicle, at least one wheel being in the form of a raisable drive wheel. The drive wheel is made of a material with a high coefficient of friction in the direction of travel, while the other wheels are made of a material with a low coefficient of friction. Furthermore, at least two rope drums, spaced apart, accommodating retaining ropes, and with a drum drive, are provided to hold the support frame. Attached on the support frame are a device for determining the lateral deviation and rotation of the support frame with respect to the linear forward movement and an device for correcting the rotation. A control device controls or regulates the correction device, in dependence on the magnitude of the lateral deviation and rotation. The invention further relates to a robot with the drive device.

23 Claims, 2 Drawing Sheets

DRIVE DEVICE FOR MOVING A ROBOT OR VEHICLE ON FLAT, INCLINED OR CURVED SURFACES, PARTICULARLY OF A GLASS CONSTRUCTION AND ROBOT WITH DRIVE DEVICE

FIELD OF THE INVENTION

The invention relates to a drive device for moving a robot or vehicle on flat, inclined or curved surfaces, particularly of a glass construction, and to a robot with a drive device.

BACKGROUND OF THE INVENTION

In recent times halls have been increasingly constructed of glass or with large glass areas, in which the glass panes are held in glass securing means of a grid lattice construction in the form of an external or internal skeleton. Frequently, such halls are so designed that the glass panes, proceeding from the apex of the roof, are inclined by a specific angle to the respective preceding pane. As in the case of such large glass areas the problem of their cleaning arises, the use of cleaning robots is considered in this area.

When a robot or vehicle moves on glass surfaces, a main problem resides in the selection of suitable kinetics for the drive and direction control of the robot or vehicle. If the construction of the glass area contains members which can serve as guide members for the robot and which permit an application of force, e.g. rail systems, these members are used for the transporting movement. If such constructive members are not present or are unsuitable, the application of force must be effected directly into the glass.

In this case problems arise in that, in order to transport the robot, the drive member, for example in the form of a wheel, must apply a force to the glass which on the one hand is greater than the rolling friction resistance between glass and wheel plus the adhesive and rolling friction resistance of the respective drive train, such as motor, bearing and the like. On the other hand the force applied must be smaller than the adhesive friction resistance between wheel and glass, as otherwise slip would occur and the wheel would "skid". As the magnitudes of the named minimum and maximum forces at low friction coefficients lie very close to one another, extremely sensitive regulation is necessary.

In addition to the transporting movement, controlled steering, i.e. influence on the direction of movement, is always necessary. The steering constructions known from the automobile are unsuitable due to the lack of available space.

OBJECT OF THE INVENTION

Therefore the object underlying the invention is to provide a drive device for moving a robot or vehicle on the surfaces particularly of a glass construction, which permit forward movement without disturbance without excessive applications of load at specific points, which could involve risk of breakage of the glass, and which enables correction of the movement in the transverse direction and another object is to provide a robot with a drive device.

This object is achieved by the features of the claims. By virtue of the fact that the device according to the invention has a drive wheel with a high coefficient of friction in the running direction of the wheel in the direction of travel, and non-driven wheels with a very low coefficient of friction, all the wheels being attached to a support frame, on the one hand an unhindered forward movement of the support frame forming a component part of a robot or of a vehicle without skid or slip and on the other hand simple lateral pushing or rotation is enabled. By means of corresponding devices, the lateral deviation and the rotation of the support frame is determined and appropriate corrections are undertaken, a control device controlling the correction devices in dependence on the magnitude of the lateral deviation and of the rotation.

BRIEF DESCRIPTION OF THE DRAWINGS

An embodiment of the invention given by way of example is shown in the drawing and is explained in more detail in the following description.

DESCRIPTION OF THE PREFERRED EMBODIMENT

Figure 1:
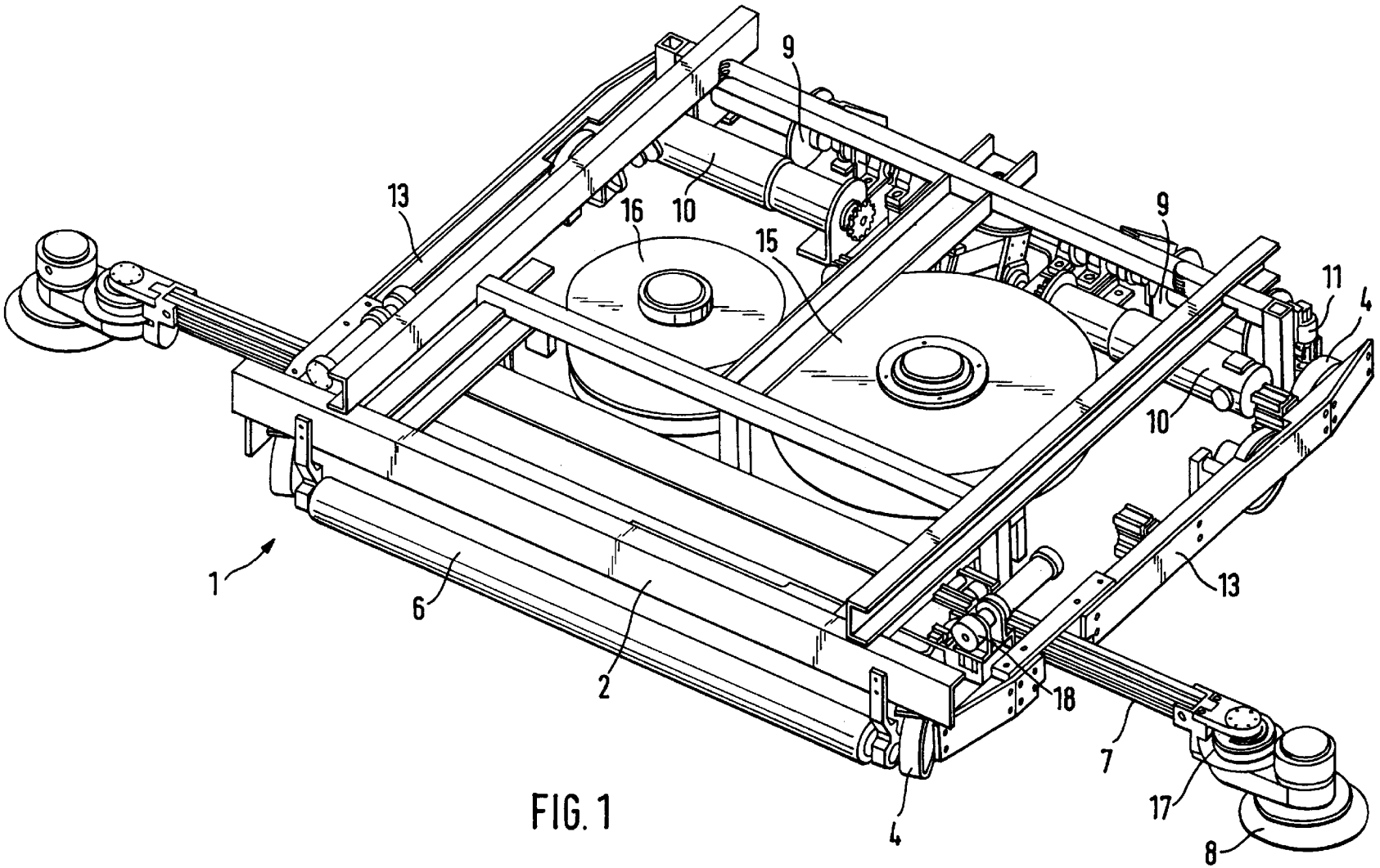
FIGS. 1 and 2 show perspective views of a cleaning robot, which includes the drive device according to the invention.
Figure 2:
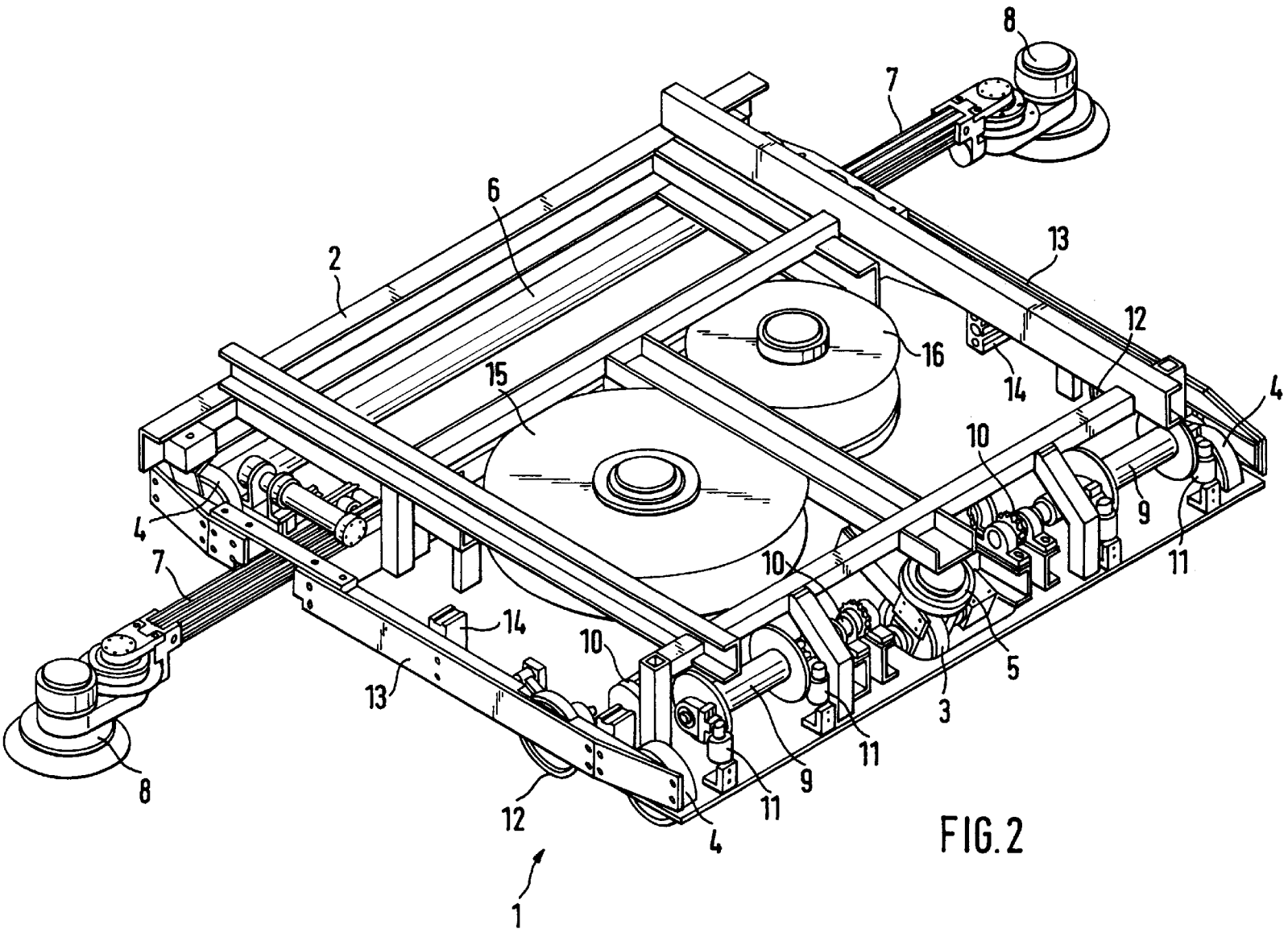

The figures show a robot 1, which in the embodiment is in the form of a cleaning robot, and which travels on a glass roof or a glass envelope of the hall, and thus cleans the glass area in accordance with its width. The embodiment shown is suitable for cleaning a grid lattice construction, which forms a grid of predetermined dimensions. The glass panes in this case are secured in glass securing means beneath the grid lattice construction.

The cleaning robot has a support frame 2, upon which the necessary components are attached. Attached to the support frame 2 at all four corners are free-running wheels 4, which preferably consist of a Teflon material or have a Teflon coating. Another material may also be selected; what is important is that it is a material with an extremely low coefficient of friction, so that the robot 1 may be easily pushed and rotated. Further provided on the rear portion of the frame 2 and centrally is a drive wheel 3, for example driven by an electric motor, which moves the support frame 2 particularly on horizontal glass surfaces. This drive wheel 3 may be raised or lowered from the glass surface via a pneumatic cylinder 5. The drive wheel 3 consists of a material which has a high coefficient of friction.

As the robot in the present embodiment is in the form of a cleaning robot, seen in the direction at the front of the support frame and vertically to the direction of travel there is attached a roller brush 6, which extends over the entire width of the support frame 2. Located laterally of the support frame are longitudinally-extended arms 7, upon which circular brushes 8 are attached via pivotal head devices 17. The arms 7 are designed to extend and retract and are driven via toothed belts by an electric motor 18.

Further attached at or on the support frame 2 are a cable drum 16 with a drive motor and a hose drum 15 with a drive motor. The cable drum 16 accommodates one or a plurality of electrical conductors, which serve at least to supply voltage to the electrical portions mounted on the support frame 2, as a cable, whilst the hose drum 15 accommodates a water hose. The cable and water hose are unwound as the robot travels. The end of the hose provided on the hose drum 15 is provided with a water distribution system not shown, which sprays water through nozzles into the area of the roller brushes 6 and the circular brushes 8.

Located at the rear end of the support frame 2 are two rope drums 9, which as far as possible are off-set outwardly. Wound onto the rope drums 9 are ropes (not shown), which normally serve as safety ropes preventing the robot from falling and which, during travel of the robot, are unwound from the rope drums 9. Where the glass areas are curved or inclined, they also serve to pull up the robot 1. Associated with the rope drums 9 are respective drum drives 10, having electric motors, with corresponding gear transmissions. The ropes are respectively accommodated across the width of the rope drums and are wound or unwound with a predetermined rope tension. For this purpose there are associated with the respective rope drums measuring devices 11 for measuring the rope tension. The drum drives and the measuring devices 11 designed as rope tension sensors are incorporated for each rope drum 9 into one regulating circuit, via which the predetermined rope tension can be maintained. For this purpose both the drum drives 10 and the rope tension sensors 11 are connected to a control and regulating device (not shown), which can be provided on the support frame 2, but which can also be located separately from the robot 1; in this case the control and regulating signals are supplied via electrical control conductors. The control and regulating device is in the form of a micro-computer or of a PC, and also serves to control the drive of the drive wheel 3 and of the motors 18 for extension and retraction of the linear arms 7 and of the pivotal heads 17. The cables, hoses and ropes wound and unwound from the cable drum 16, the hose drum 15 and the rope drums 9 must be deposited or taken up taut and without loops on the glass surface, and in a synchronous manner, and for this purpose regulating circuits are provided, via which the drives of the cable drum 16, the hose drum 15 and the drum drive 10 for the rope drum 9 are regulated by the control and regulating device. The tension which respectively acts on the cable of the cable drum 16 and the hose of the hose drum 15 is detected via the performance of the electrical drive motors of the drums 16, 15. In dependence on the sensor signals of the rope tension sensors 11 and the tensions obtained via the motor performances, the control and regulating device regulates the respective drive systems in such a way that ropes, cable and hose are deposited taut, so that no friction results on the glass surfaces.

The robot 1 also has two measuring wheels 12, which are attached in the vicinity of the rope drums 9, ideally directly above the inlet point of the rope onto the drum (this however cannot be realised, as the inlet point varies over the width of the rope drum 9). The measuring wheels 12 are likewise connected to the control device (not shown) and are formed with the rope drum drives 10 and the electric drive of the drive wheel 3 to form regulating circuits. Via the measuring wheels 12, for example by counting the revolutions of the measuring wheels 12, the distance travelled is determined. In addition, sensors such as proximity sensors can be provided on the support frame, and which detect the construction members, so that further information can be obtained regarding the distances travelled, as the construction elements are located at predetermined grids or dimensions. In dependence on the signals of these sensors, the measuring wheels 12 may be re-adjusted.

The support frame 2 is provided with lateral slide rails 13, which are extendible and retractable via respective pneumatic piston-cylinder devices 14, and which serve for support on external construction parts. The compressed air for the pneumatic components is obtained via a compressor not shown but attached to the support frame 2.

Associated with the robot 1 is a system inspection carriage, which is not shown, which is located at the upper apex of a hall, and is provided with electrical drive systems and distance measuring apparatus, via which it is moved in the direction of the axis of the hall. The ropes of the rope drums 11 of the robot 1 are connected to the system inspection carriage as well as the hose of the hose drum. Provided on the system inspection carriage is the voltage supply, which via the cable of the cable drum 9 supplies the robot 1 with the necessary voltage, and a control device in the form of a micro-computer or PC may likewise be provided. There is further located on the system inspection carriage a pump, which is connected to the hose of the hose drum 10 of the robot 1 and to a long hose, being connected to the water supply system, providing the necessary pressure for the water. Moreover, the system inspection carriage has at least one automatic take-up device, by means of which the associated robot 1 can be deposited on the glass surface or lifted off therefrom.

At the beginning of the cleaning procedure the robot 1 is deposited by the system inspection carriage at the apex point of the glass roof, and the drive wheel is lowered. It operates against the ropes unwinding from the rope drums 9, and the predetermined rope tension is adjusted via the regulating circuits by means of which the measurement values of the rope tension sensors are processed. This is effected via corresponding signals supplied by the control device to the drum drives 10. At the beginning of the process, in addition, the slide rails 13 are extended, until they respectively abut on the construction members in the grid of the grid lattice construction, so that the robot 1 is aligned inside the grid, as the non-driven wheels, due to the low coefficient of friction, present no resistance to uniform displacement. However in this case of alignment, the drive wheel 3 is raised. After alignment, the piston-cylinder devices are de-pressurised, and the start of the procedure described above is carried out with the drive wheel 3 lowered.

During the forward movement of the robot which is initiated by the lowered drive wheel 3 with a high coefficient of friction, deviation from the desired direction of travel, and caused by external or internal influences, for example by the constructive members of the glass roof, by a slight oblique positioning of the robot, during positioning or alignment etc., during the procedure, requires to be equalised after a certain distance of travel by rotation or lateral displacement of the robot 1. In order to determine the rotation of the robot 1 the measurement results of the measuring wheels 12 provided to the control device are used. Whilst the average value of the measurement results of the two measuring wheels 12 provides information regarding the distance travelled, the difference between the measurement results of one and the measurement results of the other measuring wheel 2 determines the angular rotation of the robot, which is calculated by the control device. The control device monitors the amount of the rotation angle, and at a specific threshold value emits a signal for correcting the rotation.

The lateral displacement is ascertained via the slide rails 13. When the robot deflects laterally from the desired direction of travel, it collides with the existing construction members, and as the piston cylinder devices 14 have been de-pressurised, the respective piston is slowly retracted. Provided in or at the piston cylinder device is a proximity sensor which emits a signal to the control device when the piston approaches. This signal initiates the necessary correction of the lateral deviation.

When the respective corrections are to be carried out, the control device emits a signal to the pneumatic drive for the drive wheel 3, so that the latter is raised from the glass surface. The lateral displacement is carried out by renewed extension of the lateral slide rails 13.

Correction of the rotation is also carried out with the drive wheel raised, when the robot 1 is located on an inclined glass surface. For this purpose the control device inactivates the regulation of the cable drums 9, whose associated measuring wheel 12 has the smaller quantity or the smaller measuring result. For the regulating circuit of the other rope drum 9, the control device emits a high required value for the cable tension, so that the drive 10 for this cable drum 9 is activated until, by means of rotation of the entire robot 1 about the inlet point of the stationary rope due to the "winding up" of the other rope, both measurement values of the measuring wheels 12 coincide. In this way the rotation is corrected, and the drive wheel can again be lowered. Naturally, the correction may also be carried out by regulating the rope tensions via both regulating circuits. During correction of the rotation of the robot on horizontal glass surfaces, e.g. at the start of the travelling movement, the drive wheel 3 remains lowered, so that the support frame 2 rotates about the drive wheel as a centre of rotation.

In addition, stabilisation of the movement of the robot 1 can be carried out by the fact that the forward, non-driven wheels 4 are rotatably mounted vertically to the wheel axis through a small angle, e.g. in the embodiment 15°, the vertical axis, seen in the direction of travel, being located in front of the wheel axle. Deviation of the wheels from the direction of travel caused by external disturbances leads to a restoring moment, which pulls the wheels 4 into the original direction.

Reversal of the robot 1 is carried out with the drive wheel 3 raised, only by using the regulating circuits of the rope drums 9 and of the measuring wheels 12. When the direction of movement is changed, the previously forward wheels 4 are stopped in the central position by a pneumatic cylinder (not shown), and thus for this direction of travel have a stabilising effect.

In the embodiment described, correction of the rotation is carried out via the cable tensions. If space is available it is imaginable that the forward wheels 4 can have a steering system, by means of which an alteration in position can be undertaken.

Cleaning is carried out during the downward movement of the respective robot 1 on the glass surface by means of the roller brushes 6 and laterally of the robot 1 by means of the circular brushes 8. Between the glass suspension means, the robot cleans across this width with the roller brush 6. In order to be able to circumvent the glass suspension means which are caused by the externally-lying grid lattice envelope of the hall construction, the lateral arms 7 are retracted and extended. The circular brushes 8 are pivoted via the pivotal heads 17, so that cleaning can also be carried out in the concealed area behind the glass suspension means. During travel of the robot the lateral arms are retracted and extended continuously in dependence on the travelling speed selected for the robot, in order to clean the entire lateral glass area. However, the drive for the rope drums 9 and/or of the drive wheel 3 may also be controlled or regulated in such a way that the robot 1 stops upon extension of the arms 7, moves forward and stops again for retraction.

The brushes 6, 8 are supplied with water passed via the hose of the hose drum 15. For this purpose the roller brushes 6 have bristles which become longer in the direction of the centre of the roller brush, as the glass panes bend slightly due to the weight of the robot 1, and in this way uniform application of pressure of the bristles on the glass can be ensured.

In the above embodiment, a cleaning robot has been described.

The device explained for moving a robot can also be used in other robots, such as an inspection robot or generally with a processing or working robot. The latter for example can carry out works such as painting, sand-blasting, grinding, etc., on facades. In accordance with the type of use, the cable drum and hose drum are then provided with appropriate cables and hoses, and any optional fluid or paints for painting or the like can flow through the hoses.

We claim:

1. Drive device for moving a robot or vehicle on flat, inclined or curved surfaces or facades, of a glass construction, comprising:

a support frame provided with wheels and which is a component part of the robot or vehicle, at least one wheel being designed as a raisable drive wheel, at least two rope drums with a drum drive for receiving retaining cables spaced apart which hold the support frame, a device for determining the lateral deviation and/or rotation of the support frame with respect to the linear forward movement, a device for correcting the lateral deviation and/or a device for correcting the rotation and a control and regulating device, which triggers the correction devices in dependence on the amount of the lateral deviation and/or rotation.

2. Drive device according to claim 1, wherein the raisable drive wheel has a high coefficient of friction, and the other wheels have a low coefficient of friction.

3. Device according to claim 1, wherein the device for determining the lateral deviation and/or rotation has at least two distance measuring units, spaced apart, which are connected to the correcting device and which detect the distance travelled, the control and regulating device determining the difference between the respective paths travelled by the distance measuring units and, in dependence on this difference, triggering the device for correcting the rotation.

4. Device according to claim 3, wherein the device for correcting the rotation comprises the drum drives of the two rope drums and measuring units associated therewith for measuring the rope tension, which respectively together with the control and regulating device form a regulating circuit for the rope tension, and wherein, in order to correct the rotation, the regulating circuits regulate the rope tension of at least one rope drum in such a way that the distance measuring units provide identical values.

5. Device according to claim 3, wherein the distance measuring units are in the form of measuring wheels.

6. Device according to claim 1, wherein the device for correcting the lateral deviation has extendible and retractable pressure members disposed laterally on the support frame, and which press upon externally-lying construction members of the glass construction.

7. Device according to claim 6, wherein the pressure members are in the form of pneumatically driven slide rails.

8. Device according to claim 6, wherein the pressure members are connected to pneumatic piston-cylinder devices, and wherein the device for determining the lateral deviation has sensors, attached to the piston-cylinder device, for detecting the piston stroke.

9. Robot including a drive device for moving said robot on flat, inclined or curved surfaces or facades, of a glass construction, comprising:

a support frame provided with wheels, and which is a component part of the robot, at least one wheel being designed as a raisable drive wheel, at least two rope drums with a drum drive for receiving retaining cables spaced apart which hold the support frame;

a device for determining the lateral deviation and/or rotation of the support frame with respect to the linear forward movement;

a device for correcting the lateral deviation and/or a device for correcting the rotation; and a control and regulating device, which triggers the correction devices in dependence on the amount of the lateral deviation and/or rotation.

10. Robot according to claim 9, wherein the reisable drive wheel has a high coefficient of friction, and the other wheels have a low coefficient of friction.

11. Robot according to claim 9, wherein the device for determining the lateral deviation and/or rotation has at least two distance measuring units, spaced apart, which are connected to the control and regulating device and which detect the distance travelled, the control and regulating device determining the difference between the respective paths travelled by the distance measuring units and, in dependence on this difference, triggering the device for correcting the rotation.

12. Robot according to claim 11, wherein the device for correcting the rotation comprises the drum drives of the two rope drums and measuring units associated therewith for measuring the rope tension, which respectively together with the control and regulating device form a regulating circuit for the rope tension, and wherein, in order to correct the rotation, the regulating circuits regulate the rope tension of at least one rope drum in such a way that the distance measuring units provide identical values.

13. Robot according to claim 11, wherein the distance measuring units are in the form of measuring wheels.

14. Robot according to claim 9, wherein the device for correcting the lateral deviation has extendible and retractable pressure members disposed laterally on the support frame, and which press upon externally-lying construction members of the glass construction.

15. Robot according to claim 14, wherein the pressure members are in the form of pneumatically driven slide rails.

16. Robot according to claim 14, wherein the pressure members are connected to pneumatic piston-cylinder devices, and wherein the device for determining the lateral deviation has sensors, attached to the piston-cylinder device, for detecting the piston stroke.

17. Robot according to claim 9, comprising a hose drum accommodating a hose, which is connected to a distribution system for supplying a fluid, and a cable drum accommodating at least one electrical cable, said hose drum and said cable drum being arranged on the support frame.

18. Robot according to claim 17 for cleaning purpose, comprising at least one roller shaped cleaning member disposed vertically to the direction of travel, the distribution system supplying water via the hose to the area of the cleaning member.

19. Robot according to claim 18 for cleaning purpose, wherein on the support frame laterally retractable and extendible cleaning members are arranged, which are controlled by the control and regulating device.

20. Robot according to claim 17, wherein the control and regulating device is provided, which regulates the drives of the hose drum, the cable drum and/or the rope drums in dependence on the tension.

21. Robot according to claim 20, wherein the hose drum, the cable drum and/or rope drum are synchronously regulated in such a way that the unwound hose, the unwound electrical conductor and/or the unwound rope are deposited taut without loops on the glass construction.

22. Robot according to claim 9 for inspecting purpose.

23. Robot according to claim 17 for working purpose.

* * * * *